United States Patent [19]

Clark

[11] 3,963,037

[45] June 15, 1976

[54] DEMOUNTABLE STICK

[75] Inventor: George Reginald Seymour Clark, Christchurch, New Zealand

[73] Assignee: New Zealand Inventions Development Authority, Wellington, New Zealand

[22] Filed: Aug. 21, 1974

[21] Appl. No.: 499,239

[30] Foreign Application Priority Data

Aug. 30, 1973 New Zealand ..... 171844
Jan. 28, 1974 New Zealand ..... 173204

[52] U.S. Cl. ..... 135/45 R; 52/108; 52/632; 135/15 PQ; 135/46 T; 135/47; 280/11.37 F; 403/109

[51] Int. Cl.[2] ..... A45B 9/00

[58] Field of Search ..... 135/15 PQ, 45 R, 46 T, 135/47; 52/632; 280/11.37 B, 11.37 D, 11.37 F, 11.37 H, 11.37 L; 403/107, 108, 109, 372, 377; 285/370, 383, 345; 248/188.5; 403/372, 377

[56] References Cited

UNITED STATES PATENTS

| | | | |
|---|---|---|---|
| 2,705,015 | 3/1955 | Langlais | 135/15 PQ |
| 2,890,073 | 6/1959 | Thomas | 403/377 |
| 2,947,557 | 8/1960 | Schwab et al. | 135/15 PQ |
| 3,669,133 | 6/1972 | Hyman | 135/45 R |
| 3,730,544 | 5/1973 | Hyman | 135/45 R |

FOREIGN PATENTS OR APPLICATIONS

| | | | |
|---|---|---|---|
| 196,083 | 2/1958 | Austria | 135/45 R |
| 87,612 | 7/1959 | Denmark | 135/15 PQ |
| 1,182,052 | 1/1959 | France | 135/15 PQ |
| 1,301,413 | 7/1962 | France | 135/15 PQ |
| 543,733 | 3/1942 | United Kingdom | 403/377 |

*Primary Examiner*—Werner H. Schroeder
*Assistant Examiner*—Conrad L. Berman
*Attorney, Agent, or Firm*—Ladas, Parry, Von Gehr, Goldsmith & Deschamps

[57] ABSTRACT

A lecturer's pointer, or a blind man's stick, is demountable into sections for easy stowing, but the sections cannot be separated since they are permanently connected by an axial cord. Pulling the cord without further guidance, causes the sections to join at spigot and socket joints, designed to minimize shake without binding. The cord is inherently elastic or is sprung and is put in tension to hold the joints rigid by a device on the head of the stick.

1 Claim, 13 Drawing Figures

FIG 6
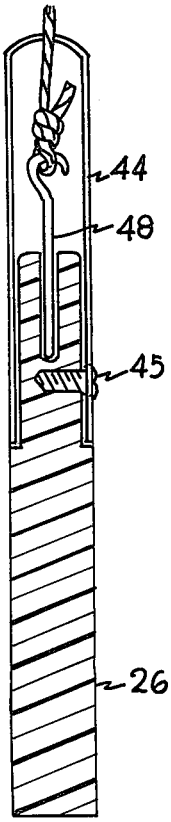
FIG 8
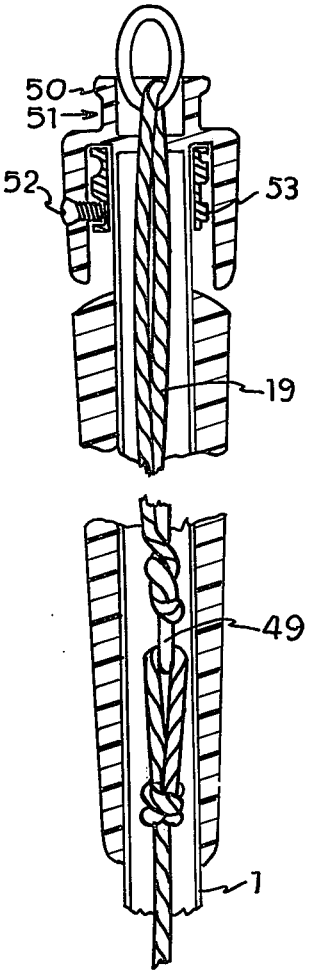
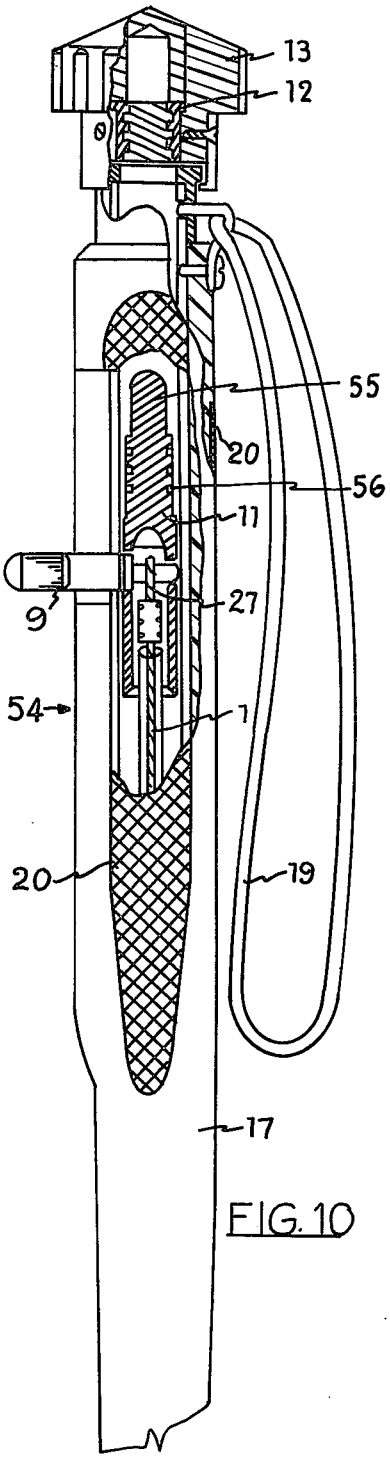
FIG. 10
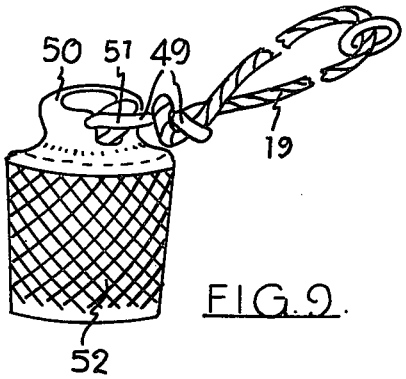
FIG. 9

DEMOUNTABLE STICK

RELATED APPLICATIONS

There are no related applications to the U.S. Patent Office.

BACKGROUND OF THE INVENTION

1. Field of the Invention

This invention relates to a demountable stick. Such a stick may be a cane as used by a blind person, and it is in relation to this that the description of the present specification applies in particular, but it can also apply to longer sticks such as might be used by a lecturer, or for a multitude of purposes.

2. Description of the Prior Art

A stick which is long enough for any particular purpose, such for instance as one that a blind person uses to help him to find his way about, may easily be so long as to be inconvenient to carry or to store. It is commonplace to divide such a stick into shafts of a length convenient for storage and equipped with joints so that the complete stick may be re-assembled. Such joints can commonly bind and be difficult to take apart. They can, on the other hand, become so loose that a joint is slack in ordinary use. It is common to adopt a compromise so that a blind man uses a stick which is shorter than would be useful but which at the same time is longer than is convenient to store.

SUMMARY OF THE INVENTION

The primary object of the present invention is the provision of a stick which can be short for transport or stowing but long enough and rigid enough to carry out its purpose when in use.

A further object is the provision of a long stick demountable into short sections, in which the sections are kept together when the stick is demounted.

Briefly the invention contemplates providing a number of short hollow shafts through which is threaded a captive cord, elastic from the properties of its material or by an added spring, in which the various shafts can be joined in spigot and socket joints which are designed to avoid both shake and binding, the avoidance of shake arising from the application of tension to the cord.

BRIEF DESCRIPTION OF THE DRAWINGS

In order that the invention may be more readily understood and carried into effect, reference is made to the accompanying drawings which, together with their description, are offered by way of example only and are not to be taken as limiting the invention, the scope of which is defined by the appended claims rather than any preceding description.

FIGS. 4, 5, 6 and 7 show three forms of foot for the stick,

FIGS. 8, 9, 10, 11 and 12 show three forms of the head of the stick to illustrate three methods of tensioning.

DETAILED DESCRIPTION

The example of the invention relates to a stick which is in general about ½ inch in diameter, 34 to 57 inches long, and consists of two or more shafts jointed together. The shafts are hollow and within them there is a single captive cord 1. This cord is put in tension to hold the shafts together.

Three methods will be described of tensioning the cord and three methods of forming the joints.

Figure 1:
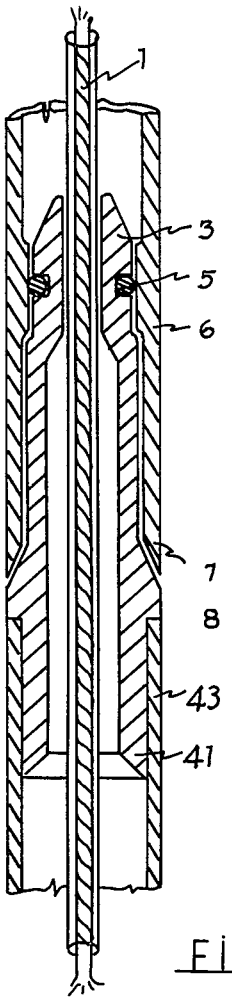
FIG. 1 shows a joint between shafts using a first form of socket.

Any two shafts mate in a spigot and socket joint, (which has an overlap of about 1¼ inch) as shown in FIG. 1. The tip of the socket 7 is coned, and centred at 1 inch from the tip is a parallel sided constriction 6 about ¼ inch long, the constriction reducing the diameter of the bore by about 1/16 inch.

A spigot 8 is an insert into the end of a plain tube 43. It is a part which may be machined or moulded and includes a plain plug 41 permanently fixed into the tube which is to carry the spigot of the joint. Above this plug is a shoulder 8 of the same external diameter as the tube, above which is a conical surface mating with conical surface 7 at the tip of the socket. At a suitable location for mating with the constriction of the socket, the spigot is reduced in diameter and is grooved to carry an O-ring 5 so that the combination of two conical surfaces and the O-ring pressed into the constriction form a joint without shake. Towards the top of the spigot there is a taper 3 to facilitate the entry of the joint. The spigot is bored to take a cord 1 which may be a slightly extensible flexible material, about ⅛ inch in diameter. The cord as fitted should increase in length by ¼ inch when subjected to a tension in the general neighbourhood of 20 lbs. Alternatively the cord is about 1/16 inch in diameter and inextensible, but is spring loaded and covered by a plastic sleeve of about ⅛ inch external diameter.

The top shaft forms a handle 17 (FIGS. 9 to 12) approximately 1 inch across and is built out on the upper tube 42 in any convenient manner. The handle may be formed of, or have bonded to it, a non-slip material 20 such as rubber or neopreme bonded cork and may be in general circular but with one flattened side so that a grip is more easily retained.

FIGS. 4, 5, 6, and 7 show methods of fitting a foot to the metal tube. The bottom length of tube 44 is threaded internally for a considerable distance from its bottom. Into this threaded tube is screwed a foot 26 which may be 3 inches long and be constructed in any manner that is convenient. The material should, of course not be brittle and should be chosen to resist abrasion. The length of the complete stick may be adjusted to suit the height of the user by cutting off part of the threaded length of tube.

Figure 7:
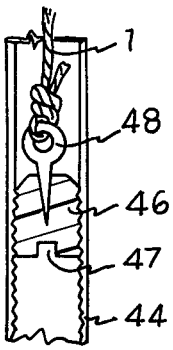
Figure 7:
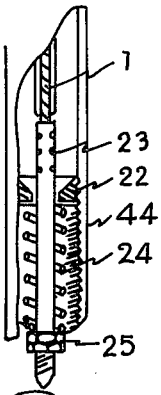
Figure 7:
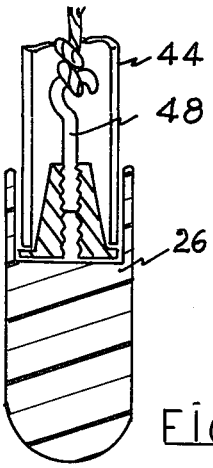

When the tube is too thin-walled to carry a screw thread, the foot can be held in place by a grub screw 45 as shown in FIG. 6, or by friction, as in FIG. 7.

Figure 4:
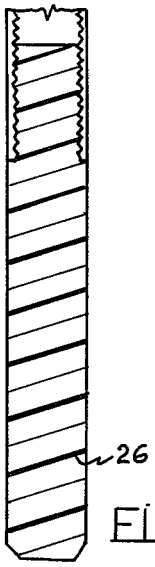

FIG. 4 shows also a first method of holding the bottom of the cord which is threaded through all the lengths of shaft. Within the screwed length of tube and above the foot 26 is a screwed plug 46 with a screw driver slot 47 on its lower face. The upper face of plug 46 carries a screw eye or screw hook 48 into which the cord is knotted. This arrangement gives a coarse adjustment of tension of the cord when the stick is assembled.

With the thin walled tube of FIGS. 6 and 7 this coarse adjustment cannot conveniently be applied and the arrangement shown in the figures must be used. Some coarse adjustment of tension may be possible by using a screw hook 48 with a long threaded shank.

Figure 5:
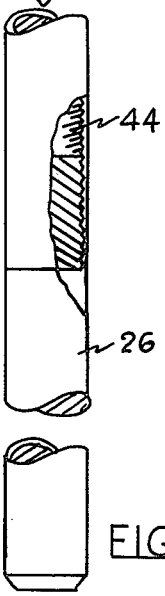

FIGS. 4, 6 and 7 apply particularly when the cord is extensible. FIG. 5 applies when an inextensible cord is used. Screwed or otherwise affixed at the top of the screwed length of tube 44 is a collar 22 through which passes a rod 23 aout ⅛ inch in diameter. To the upper end of rod 23 is affixed cord 1. The lower end of rod 23 is threaded and carries two nuts 25. Between nuts 25 and collar 22 is a helical spring 24 used in compression. The degree of compression is controlled by the tightening of nuts 25.

Figure 2:
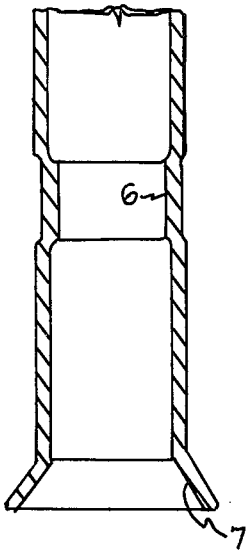
FIG. 2 shows a second form of socket.
Figure 3:
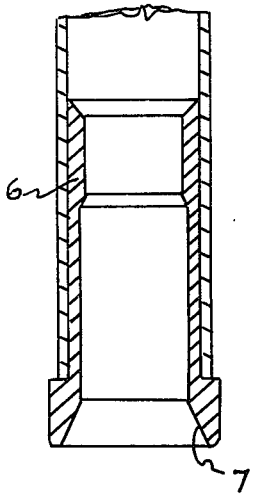
FIG. 3 shows a third form of socket.

There are three possible ways of forming the socket of the joint shown in FIG. 1. In the first a thick walled tube 6 is machined as shown in FIG. 1. This makes it possible to have a uniform external diameter of all three components of the joint, with the advantage of avoiding damage to hands. The second variant shown in FIG. 2 applies to thin walled tubes and consists in swaging in the constriction 6 and swaging out the conical surface 7. This has the draw back that it causes a rim at the joint. The third variant, which is applicable to thin walled or other relatively weak tubes, is shown in FIG. 3 and consists in forming the conical surface 7 and the constriction 6 of an insert which is held within the plain tube. This is liable to leave a ridge at the joint, but it is not essential that it should.

The cord is captive through all the shafts of the stick. This makes it possible for a blind person to assemble the stick without having to keep track separately of all the separate pieces, with the possibility of having to grope for one that had been dropped. The form of the joints is such that the components have only to be pushed together to mate, and this can be done by pulling the cord against the top section of the shaft. The components have then to be held together by tensioning the cord.

The first method of carrying this out (FIGS. 8 and 9) is to tie the top end of the cord to an eye 49, which may for convenience be double in the form of a FIG. 8, of such a size as to pass into the hollow top shaft when the shaft is disassembled. The head of the top shaft has on its top a cylindrical rim 50 bordering the central hole in the shaft. In this rim is a slot 51. When the stick is assembled, the cord can be pulled so that the eye is hooked into the slot (FIG. 9). This holds the joints moderately rigid. Their rigidity is increased by rotating the head of the top shaft which is free to rotate on the shaft, but is captive by a grub-screw 52 which engages with a buttress thread on the fixed part of the top shaft. Rotating the head increases the distance between the two anchorages of the cord, and so puts it strongly in tension.

In the second method of applying tension (FIG. 10) a loop 27 is formed at the end of the cord and through this cord a pin 9 is passed. The pin passes through a bolt 11 within the bore of the upper part of the shaft. The lower end of the bolt is hollow. The outer end of the pin passes through a slot 54 in handle 17 parallel to the axis of the shaft, and has a knurled head within the general region of the grip of the stick. The cord is put into tension by sliding the pin 9 up the slot 54.

The bolt within the shaft has within its tip a tapered or other entering part 55, below which is a coarse thread 56. At the end of the shaft is a captive knurled head 13, rotatable and internally threaded 12 to match the thread on the bolt. When the pin is slid up the slot the bolt enters the knurled head and the threads are engaged by rotating the head.

Figure 11:
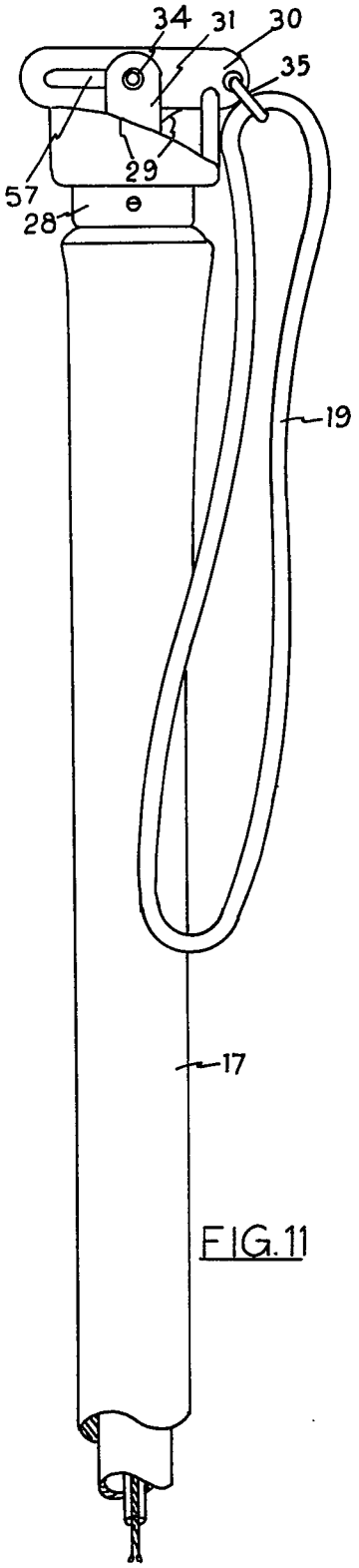
Figure 12:
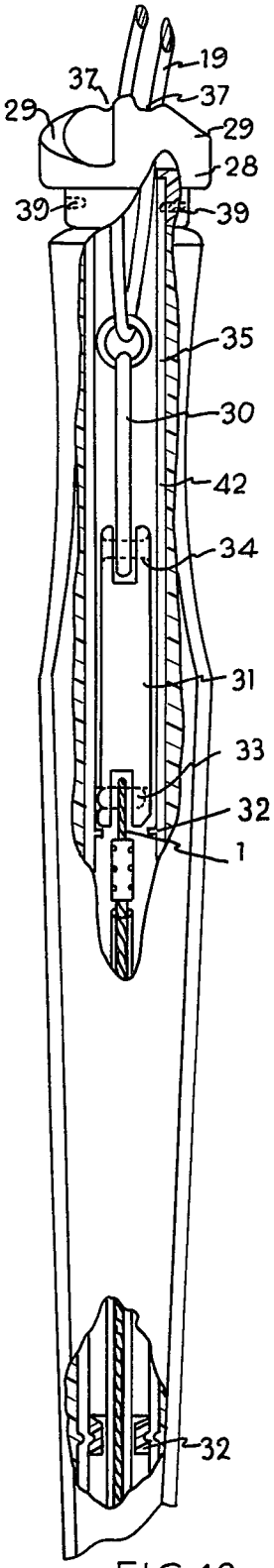

The third method of applying tension to the cord is simpler (FIGS. 11 and 12). The top of the cord 1 is looped over a pin 33 in the end of a bolt 31 which can pass within the top of the shaft. Pivotted to this is a tensioning key 30 which may be of metal or suitable plastic. It is about 1¼ inches long, three-eighths of an inch wide and one-eighth of an inch thick. Its corners and edges are radiused to prevent sticking. At one end is a hole through which passes an eye 35 by which an upper loop of cord 19 is connected. At the other end is a slot 57 extending approximately half the length of the key and having a width to take a pin 34 passing through the bolt 31. At the inner end this slot is opened up so as to provide two locating places. When the stick is disassembled (FIG. 12) the bolt rests on a stop 32 within the tube and the key lies above it. Above the key and attached to it is loop 19 which is accessible through a hole in the cap of the shaft. To tension the cord the loop is pulled up until the key is wholly clear of the hole in the shaft. The key is then turned over till it lies transverse to the shaft with the pin connecting the bolt in one of the two locating slots. The key lies across the head of the tube (FIG. 11). There can be an adjustment of tension if the key rests on two diametrically opposed ramps 29 each having a locating groove in the top.

The various parts are constructed according to well-known means so that the parts that are captive in use can be stripped for overhaul.

Figure 13:
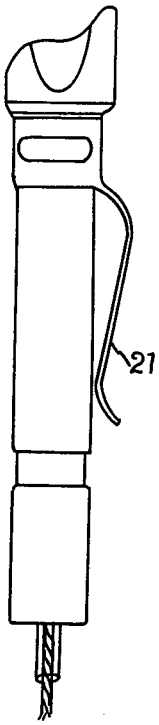
FIG. 13 shows a clip by which the stick can be carried.

The stick is fitted with an over-sized pocket clip 21 (FIG. 13) which can be hooked onto clothing to 'park' the assembled stick in order to free both hands.

Attached to an eye on the cord in the first and third methods and near the top of the stick in the second method, is a loop of elastic cord 19 (it may be made, for example, from solid rubber 3mm in diameter) which serves several purposes. It can be hung over the wrist, it can be hung on a hook, and finally, when the stick is dis-assembled and the parts are folded together the loop can be wrapped round them and hooked over the bundle of shafts. In the first and third methods, this cord carries a second eye which is too big to pass into the hollow shaft.

What I claim is:

1. A stick comprising in combination:

a plurality of hollow shafts including a first and second shaft joined together by joints wherein a first end of a first shaft carries near its tip an O-ring held in a groove and carries at a predetermined fixed distance from the O-ring an inwardly tapering male conical surface coaxial with and surrounding said first end, and a first end of a second shaft carries within said end a female conical surface coaxial with said second shaft, said second shaft being matingly engaged at its complementary female outwardly tapered conical surface by said male conical surface on said first shaft, and a second end of said second shaft carries within it a constriction located at a distance from the female conical surface equal to the distance between said O-ring and male conical surface on said first shaft, said constriction being engaged with said O-ring;

a captive elastic cord within said plurality of hollow shafts; and means at one end of said plurality of hollow shafts anchoring said elastic cord and means at the other end of said plurality of hollow shafts connected in a tension-resisting manner to said elastic cord whereby tension may be applied to the cord to define an interlocking, demountable stick.

* * * * *